US005391417A

United States Patent [19]

Pike

[11] Patent Number: 5,391,417

[45] Date of Patent: Feb. 21, 1995

[54] ASPHALTIC ROOFING MATERIAL WITH CLASS F FLY ASH FILLER

[75] Inventor: Clinton W. Pike, Coweta, Ga.

[73] Assignee: JTM Industries, Inc., Kennesaw, Ga.

[21] Appl. No.: 51,162

[22] Filed: Apr. 22, 1993

Related U.S. Application Data

[63] Continuation of Ser. No. 705,372, May 24, 1991, abandoned.

[51] Int. Cl.[6] ..... B32B 5/16; B32B 9/00; E04D 1/00

[52] U.S. Cl. ..... 428/143; 106/705; 428/283; 428/291; 428/703; 52/518

[58] Field of Search ..... 428/291, 703, 143, 283; 106/706, 706, 645, 692, 309; 52/518

[56] References Cited

U.S. PATENT DOCUMENTS

| | | | |
|---|---|---|---|
| 2,935,416 | 5/1960 | Dunbar et al. . | |
| 3,585,155 | 6/1971 | Holstein . | |
| 3,973,887 | 8/1976 | Breckenfelder . | |
| 4,288,959 | 9/1981 | Murdock . | |
| 4,328,320 | 5/1982 | Reszniak et al. . | |
| 4,331,726 | 5/1982 | Cleary . | |
| 4,405,680 | 9/1983 | Hansen . | |
| 4,489,483 | 12/1984 | Mikols . | |
| 4,741,782 | 5/1988 | Styron | 106/309 |
| 4,745,032 | 5/1988 | Morrison . | |
| 4,992,102 | 2/1991 | Barbour | 106/645 |
| 5,106,422 | 4/1992 | Bennett et al. | 106/707 |

OTHER PUBLICATIONS

"ASTM Specification C68-80."

"Study of Algal Discoloration of Asphaltic Roofing Shingles", 3 M Indsutrial Mineral Products Division Dec. 1987.

*Primary Examiner*—James D. Withers

[57] ABSTRACT

Asphaltic roofing material, such as roll or shingle roofing, employs Class F fly ash as the filler to the asphaltic base material. The fly ash is more readily heated than conventional crushed limestone which has been used as a filler, and further promotes a more rapid cooling of the composite asphaltic web prior to rolling or cutting into shingles. The Class F fly ash comprises between 40% and 70% of the hot asphaltic mixture, by weight. It may be delivered to the roofing plant in a state of elevated temperature from the fly ash source to reduce the requirement for preheating the fly ash or eliminating the preheating step altogether. The slightly acidic content of fly ash discourages the growth of fungus and mold on the roofing material in hot and humid climates, and the resulting shingle has greater overall flexibility and resistance to cracking at low temperatures, as compared to a shingle in which crushed limestone is used as the inert filler.

6 Claims, 3 Drawing Sheets

ASPHALTIC ROOFING MATERIAL WITH CLASS F FLY ASH FILLER

This is a continuation of application Ser. No. 97/705,372, filed May 24, 1991, now abandoned.

BACKGROUND OF THE INVENTION

This invention relates to asphaltic or bituminous roofing materials and methods, and more particularly to the manufacture of such roofing materials in which fly ash comprises the major part of the inert filler in the asphalt mix.

In the manufacture of roofing shingles or rolls, a heated asphaltic/filler blend is applied to a substrate web, such as a glass fiber mat or a felt. After the mat or web is impregnated with the asphaltic mix, a granular surface treatment may be applied to the hot asphaltic surface and rolled or pressed into place. The coated web composite is then cooled so that it may be cut and bundled as shingles, or formed into rolls.

Asphaltic or bituminous materials as used in the roofing industry are well known in the art, with examples being described in the U.S. Pat. No. of Mikols, 4,490,493 issued Dec. 25, 1984 and in the U.S. Pat. No. of Hansen, 4,405,680 issued Sept. 20, 1983. Prior to application to the substrate or base web, the asphalt is heated in an asphalt heater to a temperature of around 500° F. The heated asphalt is then blended with an inert filler which has also been preheated to a temperature necessary so as not to chill the mix and to facilitate blending of the filler with the asphalt.

The choice of filler has traditionally been based on considerations of availability, compatibility, and cost. An inert filler material which has been preferred and used by many roofing plants is that of powdered limestone (calcium carbonate), usually at a .rate of about 40% to 70% by weight of the mix. As noted in Mikols, other materials may be blended with the asphalt, such as block and antiblock polymers and thinnets, as well known in the art.

The rate at which a asphaltic roofing material plant can effectively operate is limited by a number of factors. One such factor is that the rate of production must allow for sufficient cool-down time to permit correct cutting and bundling of the shingles. At some production facilities, high ambient temperatures impede satisfactory chilling of the asphaltic composite felt or web, in spite of the use of water cooled chill rolls, high temperatures require a slowing down of production during periods of high ambient temperature. Little attention seems to have been paid to the use of materials, such as the selection of a filler, which would enhance, rather than impede, the cooling of the hot composite.

Powdered limestone often has been a filler of choice as it is widely available at a relatively low cost, and is compatible with the asphalt mix. However, it is a poor conductor of heat when compared to fly ash. It is relatively slow to heat, and thereafter, in the mix, tends to insulate the asphalt and retard the cooling of the composite web.

Calcium carbonate (limestone) is an active base material, and it therefore tends to be acted upon by the weak acid in the precipitation (acid rain) and is believed to contribute to a shortened life of the roofing material.

More importantly, the limestone filler has been documented as the cause of algae growth and. discoloration in asphaltic shingled roofs. The principle, if not the only alga which attacks roofs is of the genus gleoacapsa, an organism which grows naturally in harsh environments on limestone cliffs, cement or limestone walls, and roofs formed with a limestone filler The limestone filler material is thought to give the alga a competitive advantage over other microorganisms, since limestone is a sedimentary rock derived from marine organisms and is rich in nutrients. The carbonate released from the limestone is believed to provide a moderately alkaline environment that favors algal growth. Besides nourishment, the porosity of the limestone filler retains moisture and provides a growth surface for the alga.

SUMMARY OF THE INVENTION

This invention relates to the manufacture of asphaltic roofing material in which the asphaltic filler is substantially or exclusively fly ash.

While Mikols listed fly ash as one of a large number of possible inert fillers for asphaltic mixes, its particular properties and advantages are not believed to have been recognized as a substitute for calcium carbonate in the manufacture of roofing rolls and shingles. Also, the references in which fly ash has been mentioned have not identified fly ash by its particular type or by its characteristics which enhance the manufacture and improve the quality of the final product. In particular, the art has failed to recognize the role played by the filler in the cooling of the hot laminate during manufacture, or its role in the resistance to weathering caused by the weakly acidic content of certain precipitation or the resistance which it imparts to the growth of mold.

It has been discovered that asphaltic roofing materials, such as "felted" roll and shingle materials, can be manufactured with less heat energy expended and with a shortened cooling time, by the use of a filler comprising class F type fly ash as it is defined in ASTM C-618-80. Generally, this fly ash is a waste byproduct of burning pulverized bituminous (eastern) coal which is collected by electrostatic precipitators at coal burning power plants.

While such fly ash is believed to have about the same specific heat as the carbonate it replaces, it is a superior conductor of heat. Its greater thermal conductivity, believed to be due to its iron and alumina content, permits it to be brought up to an elevated mixing temperature more rapidly or with less energy than limestone. The same attribute contributes to a significantly more rapid rate of cooling. One of the limiting factors in the production rate is the web temperature at the cutter. Roofing production may be increased or the number of water chill rolls may be reduced by using fly ash versus calcium carbonate. Tests and full scale production runs comparing Class F fly ash with powdered limestone have shown a 10 to 20% greater cool down rate for Class F fly ash.

A further advantage of the use of Class F fly ash resides in the fact that it consists mainly of silica, and alumina in a glass matrix. These materials are relatively unaffected by the acid content of rain. Also, compared to limestone, fly ash is lighter in weight, permitting bulk to be added without weight penalty, or permitting the manufacture of a lighter weight product. Class F fly ash naturally has a low pH and discourages the attachment of molds, algal and fungi.

Further, and surprisingly, it has been found that shingles made with Class F fly ash as filler, and otherwise identical to shingles made with a limestone filler, have a beam strength (are stiffer) while, at the same time, may be bent about a smaller radius without cracking. The superior flexibility is very important at cool temperatures, such as at 40° F. This is believed to be due to the generally spherical nature of the fly ash particle, the ability of such particles to move relative to each other during bending of the shingle without inducing localized stress points, and the type of bond formed between the fly ash and asphalt.

The use of fly ash makes possible further energy savings, in that, when formed, collected and stored, it can be very hot, and tends in bulk to retain the heat for a time sufficient to permit delivery and use at a roofing plant while still at an elevated temperature. With planning, and under the proper conditions, it is possible to deliver the fly ash at high elevated temperature for immediate use, permitting the elimination or bypassing of conventional filler preheating equipment now in use. Also, this method utilizes a material that is otherwise considered as a waste product, requiring proper disposal.

It is therefore an object of the invention to provide a method of making asphaltic roofing materials, such as rolls and shingles, using Class F fly ash as the filler, and the provision of a roofing material so made.

A further object of the invention is the provision of a method which reduces the energy requirements in the manufacture of asphaltic roofing materials, and which can reduce the unit cost and/or increase the rate of manufacture in existing and new manufacturing locations.

Another object of the invention is the provision of an improved roll or shingle type roofing material and method of making the same which has superior strength and bendability, improved resistance to weathering, and improved resistance to fungus growth.

These and other objects and advantages of the invention will be apparent from the following description, the accompanying drawings, and the appended claims.

DESCRIPTION OF PREFERRED EMBODIMENT

Figure 1:
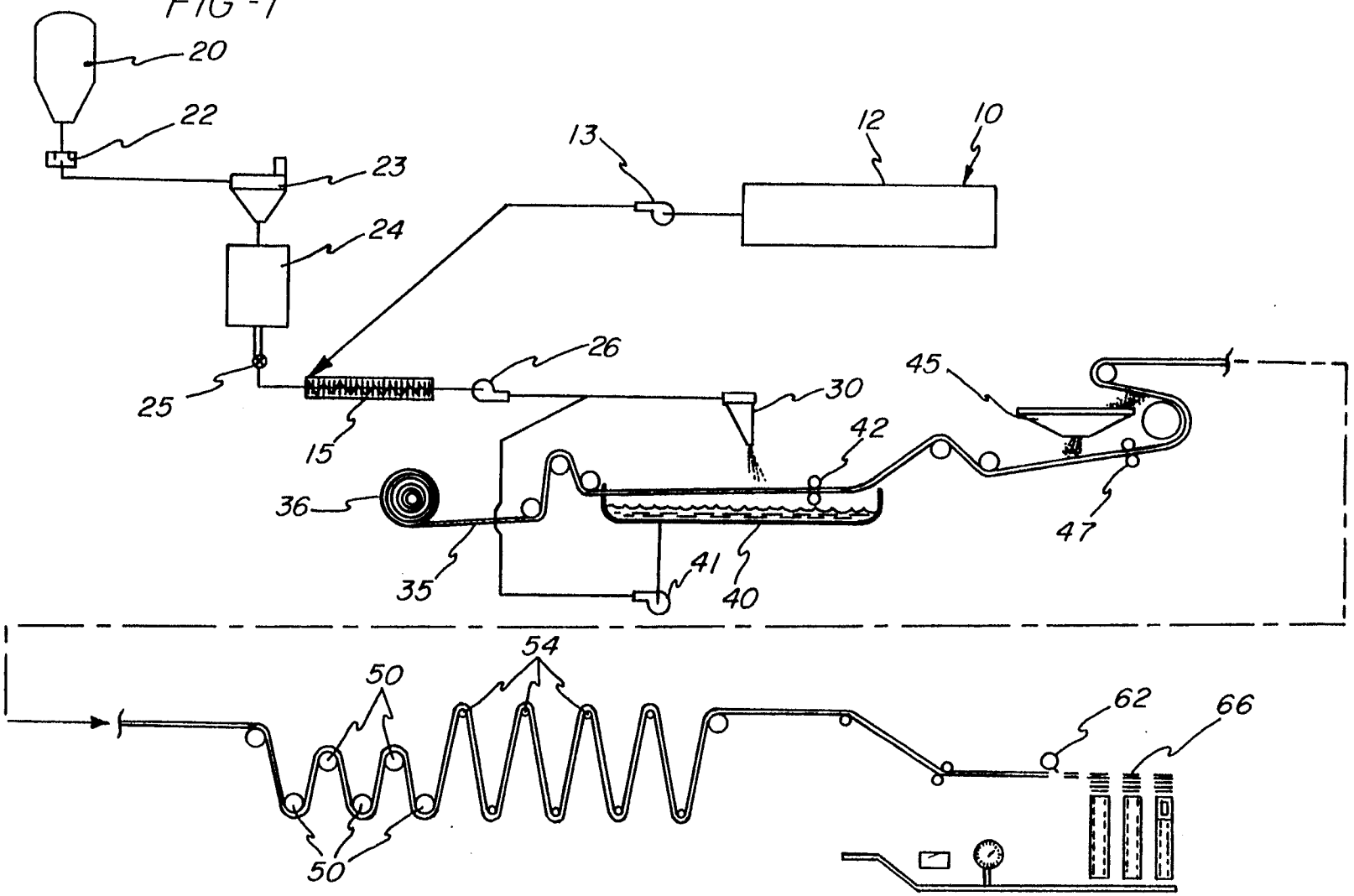
FIG. 1 is a flow diagram of a typical asphaltic roofing shingle plant to which this invention may be applied.

The practice of this invention is not limited to any particular roofing facility and may be used with advantage by a wide variety of asphaltic roofing facilities and plants. A typical but not limiting plant layout is illustrated in the diagram of FIG. 1.

A source 10 of raw unheated asphaltic material, forming the base material for the roofing, is applied to a heater 12 where the temperature of the asphaltic base material is substantially elevated for ease of handling and blending, up to 180° C. or more. The basic asphaltic material may be suitably blended from a bituminous base or stock, with polymeric blocks, anti-blocks, and solvents as is well known and understood in the art.

The heated asphaltic mix is then applied by a pump 13 to a mixer or blender 15. The blender 15 may be of the paddle type and may be jacketed with a heated jacket in order to add further heat or to provide for stabilization of the mix.

In the practice of this invention, Type F fly ash or its equivalent, classified and as defined in accordance with ASTM-C-618-80, is employed. Typically, the fly ash used is collected from pulverized coal burning plants, such as power plants. The fly ash is very fine in that from at least about 70% up to 90% or 95% will pass through a 325 mesh screen.

Chemical analysis shows that fly ash of this type is primarily silicon dioxide, iron and aluminum oxide, with some loss on ignition material, namely, carbon. The silicon dioxide may occupy from 20% to 50% of the fly ash by weight, the aluminum oxide may occupy from 5% to 40% by weight and the iron oxide may occupy from 5% to 25% by weight. The aluminum oxide is in the form $Al_2O_3$ and the iron is fully oxidized in the form $Fe3O_4$. Typically, the iron and aluminum oxide oxides are substantially or fully encapsulated within the glass spheres represented by the silicone dioxide and this is one of the reasons why fly ash is highly stable, in other words, is inert. While the carbon content may range from 0% to 20%, depending on the source of the fly ash, ranges around 5% are typical.

The fly ash may be stored in a silo 20 as diagrammed in FIG. 1. The silo 20 feeds a blower 22 which feeds the ash through a surge tank 23 to a heater 24. The heater 24, which may be a gas heater, elevates the temperature of the fly ash filler up to an elevated temperature prior to mixing with the asphaltic base material. Typically, the filler will be heated to a temperature somewhat approximating that of the asphalt or to a temperature somewhat lower than that of the asphalt by a differential of some 30° F.–60° F., the controlling factor being the viscosity of the mix. The fly ash may be volumetrically fed for blending to the blender 15 through a rotary feed valve 25.

Typically, the fly ash is delivered from the storage facilities of a pulverized coal burning plant to the asphalt plant in a pneumatic delivery truck, and is blown from the truck into the filler silo 20. Typically, the temperature of the fly ash in the truck will be from 90° F. to 150° F. range, and if promptly used, will decrease the amount of additional heat which must be added by the heater 24. However, it is within the scope of the invention to provide especially designed receiving and storing systems to accept fly ash collected from hot side electrostatic precipitators which operate in the 600° F. range producing fly ash with plus 500° F. temperatures. Fly ash using the equipment described above can deliver a filler temperature up to 325° F. or more, bypassing the heat source required, so that it may be directly fed by a volumetric feeder, such as the feeder valve 25, without requiring further heating.

Typically, Class F fly ash is gathered from electrostatic precipitators or baghouses and is considerably finer than the crushed calcium carbonate presently used, having a mean particle size of about 20 microns. Rather than being angular as in the case of the crushed limestone, the particles are generally spherical.

The specific gravity of such fly ash is about 2.4 and in replacing limestone having a specific gravity of 2.65, this difference should be taken into account if an attempt is being made to produce roofing or shingles of a specific weight. For example, when the fly ash filler is 65% by weight, it will actually occupy some 71% by volume in the blended coating as compared to the carbonate. Accordingly, the roller nips in the system should be adjusted to allow for equivalent volumes, and therefore an equivalent quantity of the asphaltic base. When the fly ash filler is adjusted to allow for equivalent volumes and therefore an equivalent weight of asphalt, the finished shingle will actually be lighter by about 10% as compared to the equivalent shingle made with a calcium carbonate filler.

Figure 2:
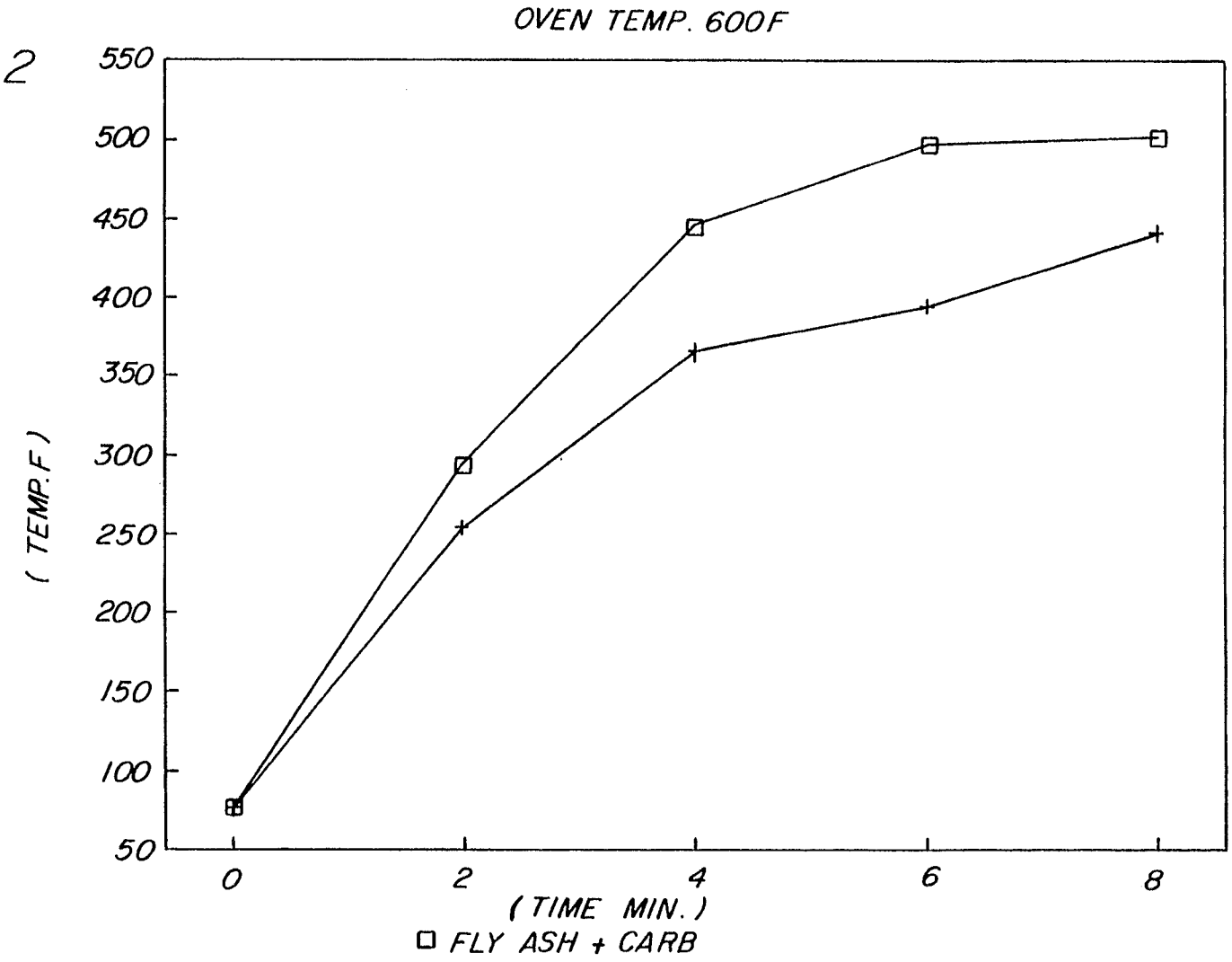
FIG. 2 is a diagram comparing the rate of heating of Class F fly ash and calcium carbonate.

Also, care should be taken to reduce the amount of heat energy applied to the heater 24 in converting from limestone to Class F fly ash. The difference in the rate at which these two products may be heated is illustrated in the diagram of FIG. 2, which represents the curves for the rate of heating 10 grams of Class F fly ash in a 600° F. oven as compared to the rate of heating 10 grams of powdered calcium carbonate. The increasing areas between the curves, representing the plots of temperature for fly ash versus the calcium carbonate, is representative of the energy which is saved by using Class F fly ash as the filler with respect to the heating of the fly ash to the desired elevated temperature.

After mixing in the blender 15, the mixture is applied by a pump 26 to a headbox 30 for application to a substrate web 35. The web 35 may be a felt as used in roofing rolls or organic shingles, or can be a woven fiber glass mat. Whichever mat is used the web 35 is drawn from a spool or supply 36 over a collection pan 40 in a generally straight run. The headbox 30 is positioned above the pan 40 to apply the heated asphaltic/-filler mixture to the substrate web 35, effecting complete saturation of the web. In other arrangements, the web 30 may be submerged in a vat of the heated mixture for penetration into the web. In some arrangements a pump 41 is connected to recirculate the mixture collected by pan 40 to the headbox 30.

The composite web 35 exits the coater through a pair of pressing rolls 42 where the excess quantity of the mixture is removed, and from these to a granular coating station.

The coating station includes a granular applicator box 45 which applies the facing granules to the composite web 35. A pair of facing rolls 47 press the granules into the composite web while the excess of granules are recycled as the composite web is brought back over the hopper 45.

From this point, the composite web 35 is carried to a cooling station normally comprising a series of chill rolls, such as the water cooled rolls 50. From the chill rolls the web may pass to a festoon in the form of a plurality of movable hangers 54 which operate, as conventional in the art, to provide temporary storage for the quantity of the now finished composite roofing web. At this point, the roofing may be rolled into finished rolls or may be fed to a cutter 62 where 2the web is cut into stacks 66 of shingles and bundled.

As previously described, the use of the Class F fly ash as the filler results in a more rapid cooling of the composite web 35 at the chill rolls 50 as compared to the conventional carbonate filler. It has been found that the filler serves to transfer the heat out of the composite some 10–20% faster than that where normal limestone fillers are used.

Figure 3:
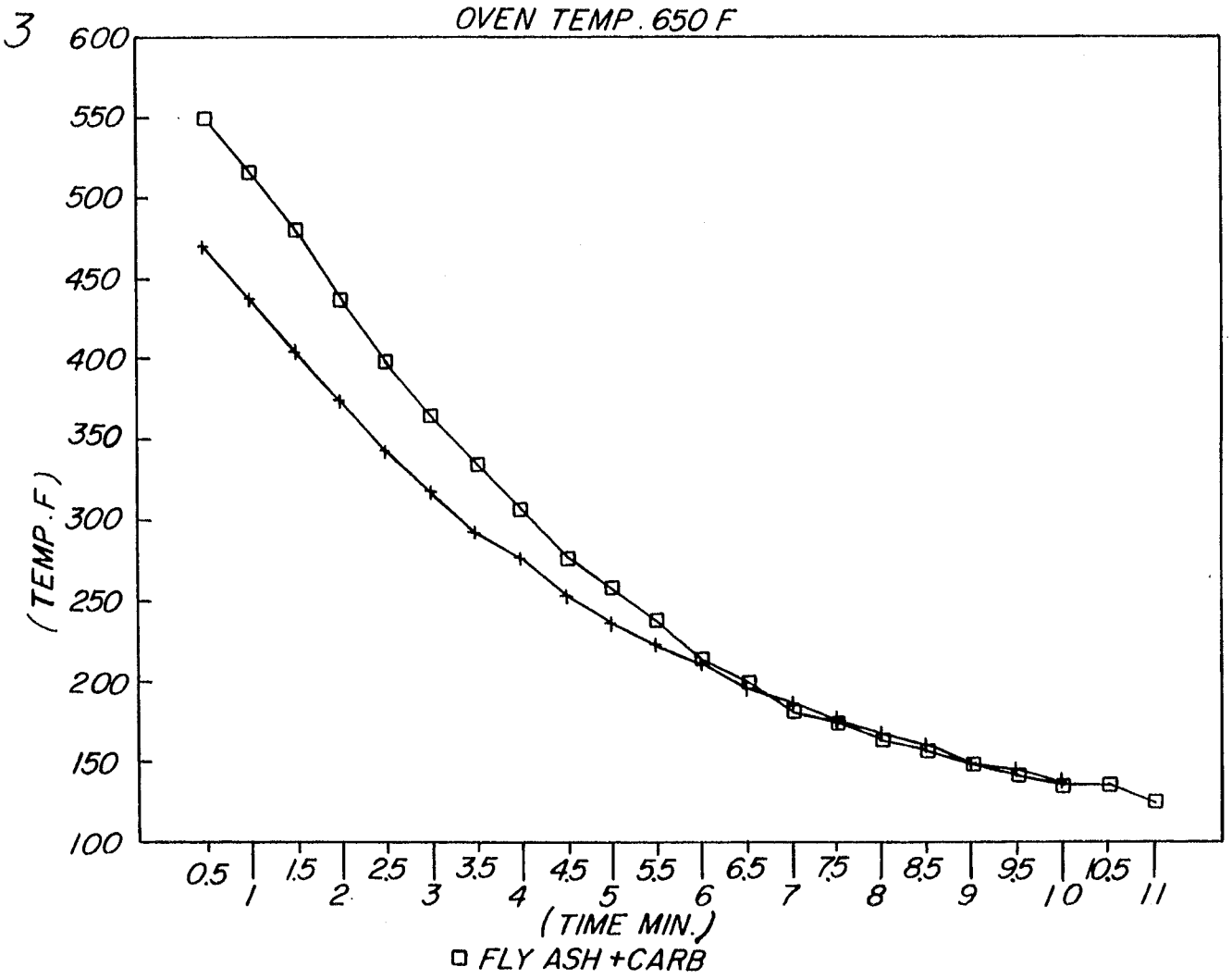
FIG. 3 is another diagram comparing the rate of cooling of Class F fly ash and calcium carbonate.

FIG. 3 illustrates the relative cooling rate of 10 grams of fly ash compared to 10 grams of calcium carbonate, as previously identified in connection with FIG. 2, with time plotted versus temperature. The ambient temperature was 75° F. Again, as in the case of heating diagram in FIG. 2, the carbonate is shown as starting at a higher temperature and cooling at a substantially steeper slope or rate than that of the calcium carbonate. The steepness of the slope is indicative of the rate of heat conduction from the center and out of the 10 gram sample. This enhanced rate is believed to be due to the presence of the metal salts inherent in the fly ash, such as the iron oxide and aluminum oxide. A contributing factor could also be the spherical shape of the fly ash particles as forming a more ideal heat radiation surface.

The resulting product, whether it be a roll or stack of shingles 66 is one which can be made lighter in weight as compared to conventional shingles with a calcium carbonate filler, and one which inherently has a lower pH and one which is resistant to the attachment and growth of algae. Surprisingly, while shingles made according to this invention when the filled asphalt is loaded at equivalent weights of fly ash versus limestone have a higher beam strength in that they are found to be somewhat more rigid and resistant to bending, at the same temperature, as compared to the shingle with the limestone filler, nevertheless, they exhibit a greater overall flexibility.

A particular test which has been used in the roofing industry to determine flexibility, is to wrap a piece of the roofing material or shingle around a one-inch pipe at ambient temperature such as at 72° F. and then at 40° F. A calcium carbonate filled shingle will wrap around a one-inch mandrel at 72° F. but will break or crack when wrapped around a one-inch mandrel at 40° F., but can be wrapped around at two-inch mandrel at 40° F. On the other hand, a shingle made with Class F fly ash as the filler in accordance with this invention, can be wrapped around a one inch pipe at 40° and not crack. The results of this bending test, showing superior flexibility, was not expected.

In the practice of the invention, typically the amount of fly ash filler to be applied is from about 40% to 70% by weight of the mixture, and more commonly within the 50–65% range. Further, the practice of this invention reduces the necessity for providing the conventional amount of cooling to the composite processed web before it can be handled by the cutter. Alternatively, the rate of production may be increased, or during hot weather, need not be slowed down, due to the enhanced ability of composite to dissipate its heat, as compared to a composite in which limestone is the filler. Plants that use other methods of cooling the sheet, such as refrigerants, will use less energy and shorten the cooling cycle.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. Asphaltic roofing material in the form of a roll or shingle in which a hot mixture of an asphaltic base and inert filler is applied to a substrate such as a felt or mat of fiber glass, the improvement in which said filler comprises Class F fly ash.

2. Asphaltic roofing material of claim 1 in which said filler is between about 40% and 70% by weight of said mixture.

3. Roofing material having increased resistance to fungus comprising:

a) a substrate web, and b) an asphaltic mixture coated on said substrate web, said mixture comprising an asphaltic base and an inert filler material dispersed in said asphaltic base, said inert filler comprising class F fly ash, said mixture comprising about 40–70 weight percent of said fly ash.

4. Roofing material as recited in claim 3 wherein at least about 70% of said fly ash is capable of passing through a 325 mesh screen.

5. Roofing material as recited in claim 3 formed into a shape adapted for use as a roofing shingle.

6. Roofing shingle having increased resistance to fungus and exhibiting superior flexibility, said shingle comprising:

a) a substrate web, and b) an asphaltic mixture coated onto said substrate, said mixture comprising an asphaltic base and an inert filler material dispersed in said asphaltic base, said inert filler consisting essentially of class F fly ash particles, said mixture comprising about 40–70 weight percent of said fly ash particles, said shingle being capable of being wrapped around a one inch pipe at 40° F. without cracking.

* * * * *